US007032493B2

(12) United States Patent
Fowler

(10) Patent No.: US 7,032,493 B2
(45) Date of Patent: Apr. 25, 2006

(54) ROCKET LAUNCHER SYSTEM AND METHOD FOR CONTROLLING A ROCKET LAUNCHER SYSTEM

(75) Inventor: Dean Fowler, Lidingö (SE)

(73) Assignee: Forsvarets Materielverk, Stockholm (SE)

( * ) Notice: Subject to any disclaimer, the term of this patent is extended or adjusted under 35 U.S.C. 154(b) by 0 days.

(21) Appl. No.: 10/432,633

(22) PCT Filed: Dec. 7, 2001

(86) PCT No.: PCT/SE01/02709

§ 371 (c)(1),
(2), (4) Date: Dec. 2, 2003

(87) PCT Pub. No.: WO02/46682

PCT Pub. Date: Jun. 13, 2002

(65) Prior Publication Data

US 2004/0069135 A1 Apr. 15, 2004

(30) Foreign Application Priority Data

Dec. 8, 2000 (SE) ..... 0004531

(51) Int. Cl.
*F41F 5/04* (2006.01)
*F41F 7/00* (2006.01)

(52) U.S. Cl. ..... 89/1.805; 89/1.802; 89/1.804; 89/46

(58) Field of Classification Search ..... 89/1.815, 89/1.801, 1.802, 1.803, 1.804, 1.805, 45, 89/46

See application file for complete search history.

(56) References Cited

U.S. PATENT DOCUMENTS

| | | | | | |
|---|---|---|---|---|---|
| 2,985,072 | A | * | 5/1961 | Carlberg et al. | 89/1.802 |
| 3,054,330 | A | * | 9/1962 | Carlberg | 89/1.802 |
| 3,113,486 | A | * | 12/1963 | Kongelbeck | 89/1.802 |
| 3,166,975 | A | * | 1/1965 | Landstrom et al. | 89/1.802 |
| 3,288,421 | A | | 11/1966 | Peterson | 248/396 |
| 3,526,166 | A | * | 9/1970 | Pfister | 89/1.802 |
| 3,567,163 | A | * | 3/1971 | Kepp et al. | 244/3.14 |
| 4,305,325 | A | | 12/1981 | Lange et al. | 89/1.815 |
| 5,020,412 | A | | 6/1991 | Adams | 89/1.805 |
| 5,119,627 | A | * | 6/1992 | Bradford et al. | 60/251 |
| 5,129,307 | A | | 7/1992 | Cain et al. | 89/1.815 |
| 5,177,318 | A | * | 1/1993 | Martinez et al. | 89/46 |
| 5,452,640 | A | | 9/1995 | Bovee et al. | 89/1.815 |

FOREIGN PATENT DOCUMENTS

| | | | |
|---|---|---|---|
| DE | 32 08 169 | A1 * | 9/1983 |
| DE | 33 41 875 | A1 * | 5/1985 |
| FR | 2 757 440 | | 6/1998 |
| FR | 2 780 670 | | 1/2000 |
| SE | 507 662 | | 6/1998 |

* cited by examiner

*Primary Examiner*—Stephen M. Johnson
(74) *Attorney, Agent, or Firm*—Jacobson Holman PLLC

(57) ABSTRACT

A rocket launcher system and a method for controlling a rocket launcher system. The rocket launcher system is placed below deck on a ship to improve the ship's stealth capability and includes a launcher, a charger and a magazine containing one or more different types of rocket missiles. According to the method for controlling the rocket launcher system, an operating signal including preparation data is transferred to the rocket launcher system from one or more operators. The preparation data is transferred to a rocket missile and a charger takes the rocket missile from a magazine and charges a launcher. A hatch in the ship's deck is opened, and the launcher sights the rocket missile at a target area.

25 Claims, 6 Drawing Sheets

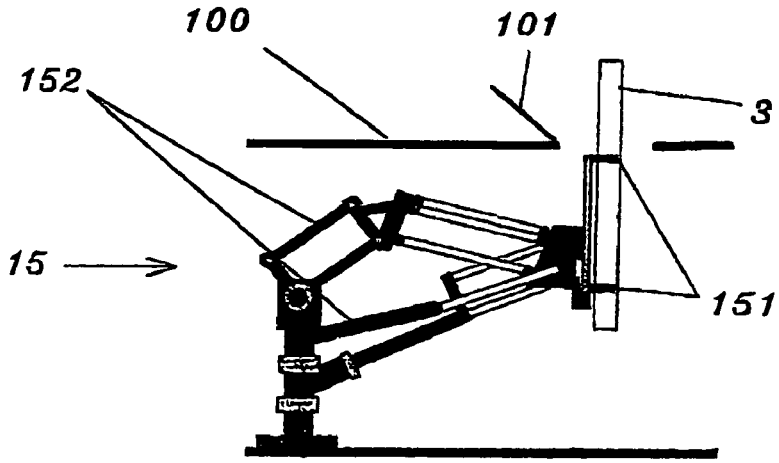
FIG. 7a
FIG. 7b
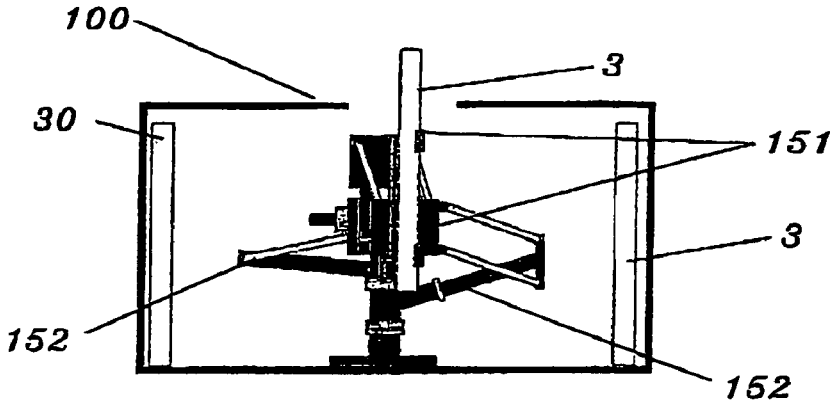
FIG. 7c
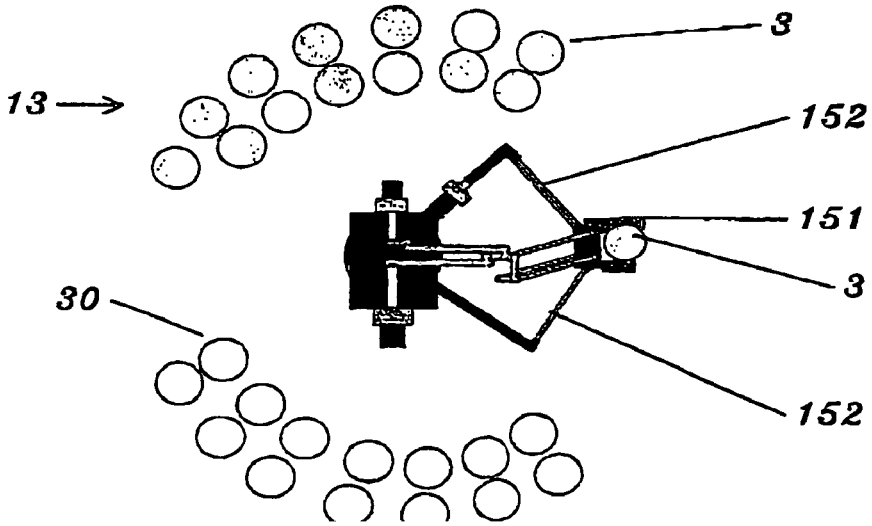

ROCKET LAUNCHER SYSTEM AND METHOD FOR CONTROLLING A ROCKET LAUNCHER SYSTEM

This is a nationalization of PCT/SE01/02709 filed Dec. 7, 2001 and published in English.

BACKGROUND OF THE INVENTION

1. Field of the Invention

The present invention relates to a rocket launcher system and a method for controlling a rocket launcher system.

2. Description of the Related Art

Modern warships have a large number of different weapons systems to be able to perform an operation against different types of targets or protect themselves from various threats. In the last decades, canons have been replaced by guided missiles as the primary weapons system of the ship. Today's ships are constructed with regard to the missile systems and the associated sensors that are to be available on board. Missile systems are in most cases large and usable against a restricted type of targets while at the same time the missiles are extremely expensive themselves. Therefore many ships also have different types of rocket launcher systems to perform the tasks that the missile systems cannot manage, or as a less pensive complement. The most common type of rocket missile is used for anti-submarine warfare, deception or as self-defence against approaching air-to-surface missiles.

Documents U.S. Pat. No. 5,452,640 A, U.S. Pat. No. 5,129,307 A, U.S. Pat. No. 4,305,325 A and U.S. Pat. No. 5,020,412 A disclose different types of rocket launcher systems. A common feature is that they all consist of a launcher standing on deck and a control unit controlled by an operator. The launcher is charged manually by the crew on deck with the type of rocket missiles for which the launcher is configured.

A drawback of the above rocket launcher systems is precisely that they are placed on deck. One of the more important novelties on new ships is their greatly improved capability of avoiding discovery, and an important way of achieving this is to place all weapons system below deck. Placing a rocket launcher system in a closed space below deck causes, however, a large number of new problems. One is that recharging becomes difficult. When a rocket missile is fired, gases dangerous to health form, which have to be ventilated away before the crew can enter and perform a recharge. This results in unacceptably long recharging times. Another problem is restrictions as to space and weight that will be considerably narrower when placing the rocket launcher system below deck.

Yet another problem of prior-art rocket launcher systems is that they are designed for a particular type of rocket missile. More types of rocket missiles require a larger launcher or more launchers. On a ship where space on and below deck is scarce, this means great compromises.

SUMMARY OF THE INVENTION

The object of the present invention is to provide a rocket launcher system and a method for controlling a rocket launcher system which solve the above problems. According to the invention, this is achieved by a rocket launcher system comprising a launcher and a charger that fetches a rocket missile from a magazine and charges the launcher which then sights the rocket missile at a target area. The method of the present invention includes the steps of transferring an operating signal containing preparation data to the rocket launcher system and transferring preparation data to a rocket missile; taking, by a charger controlled by the operating signal, the rocket missile from a magazine, and charging a launcher having a parallel kinematic robot structure with the rocket missile; and sighting, by the launcher as controlled by the operating signal, the rocket missile at a target area.

BRIEF DESCRIPTION OF THE DRAWINGS

The invention will now be described with reference to the accompanying drawings.

FIGS. 7*a–c* show an example of a launcher/charger of the TAU type.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
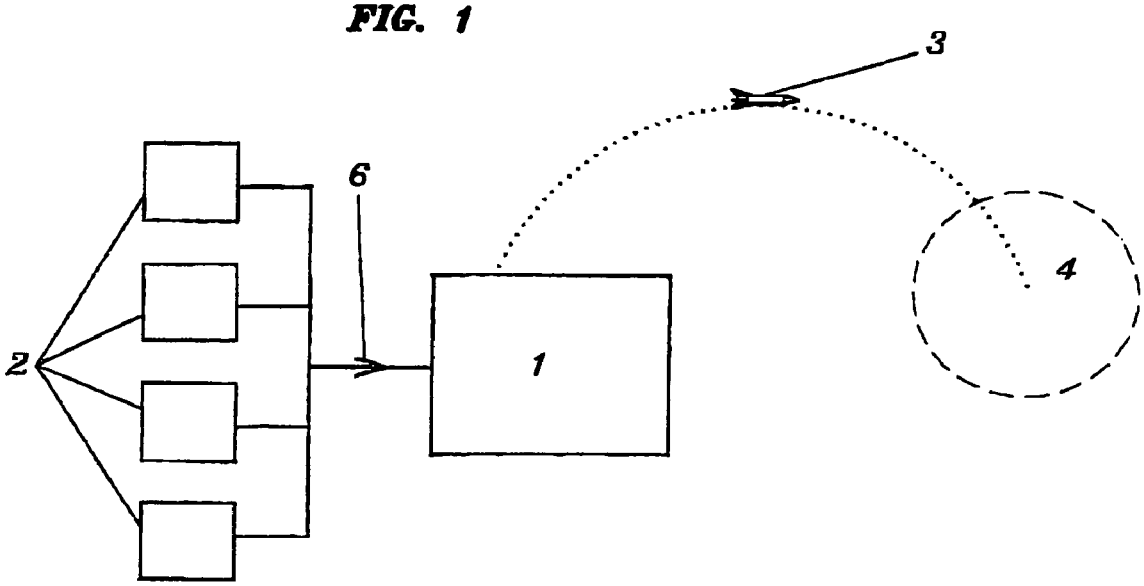
FIG. 1 shows a rocket launcher system according to the invention.
Figure 2:
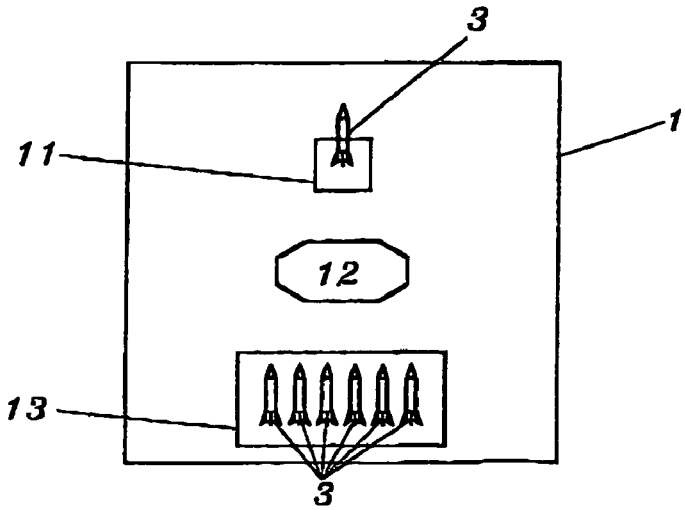
FIG. 2 shows a rocket launcher system according to the invention.

FIGS. 1 and 2 show a rocket launcher system (1) comprising a launcher (1), a charger (12), and a magazine (13), containing one or more different types of rocket missiles (3). For the rocket launcher system (1) to be able to sight the rocket missile (3) at a target area (4) and select the core type of rocket missile (3), an operator (2) sends an operating signal (6) to the rocket launcher system (1). The operating signal (6) contains information about the type of rocket missile that is to be used, information about target and target area (4), and other data that is required for the performing of the operation, which data will henceforth be referred to as preparation data. The rocket launcher system (1) also comprises a computer which processes the transferred operating signal (6) and is in contact with the sensors of the ship and other available sensors. When the rocket launcher system (1) has received the operating sisal (6), a suitable rocket missile (3) is prepared i.e. charged with preparation data. The preparation advantageously takes place when the rocket missile (3) is still in the magazine (13), but can also take place in the charger (12) or the launcher (11). The charger (12) then takes the rocket missile (3) from the magazine (13) and charges it into the launcher (11). Before or while the launcher (11) sights the rocket missile (3) at a target area (4), the preparation data in the rocket missile (3) can be updated if the rocket launcher system (1) has received new information from the sensors available or if the operator (2) wants to make changes. Then the rocket missile (3) is fired from the launcher.

Figure 3:
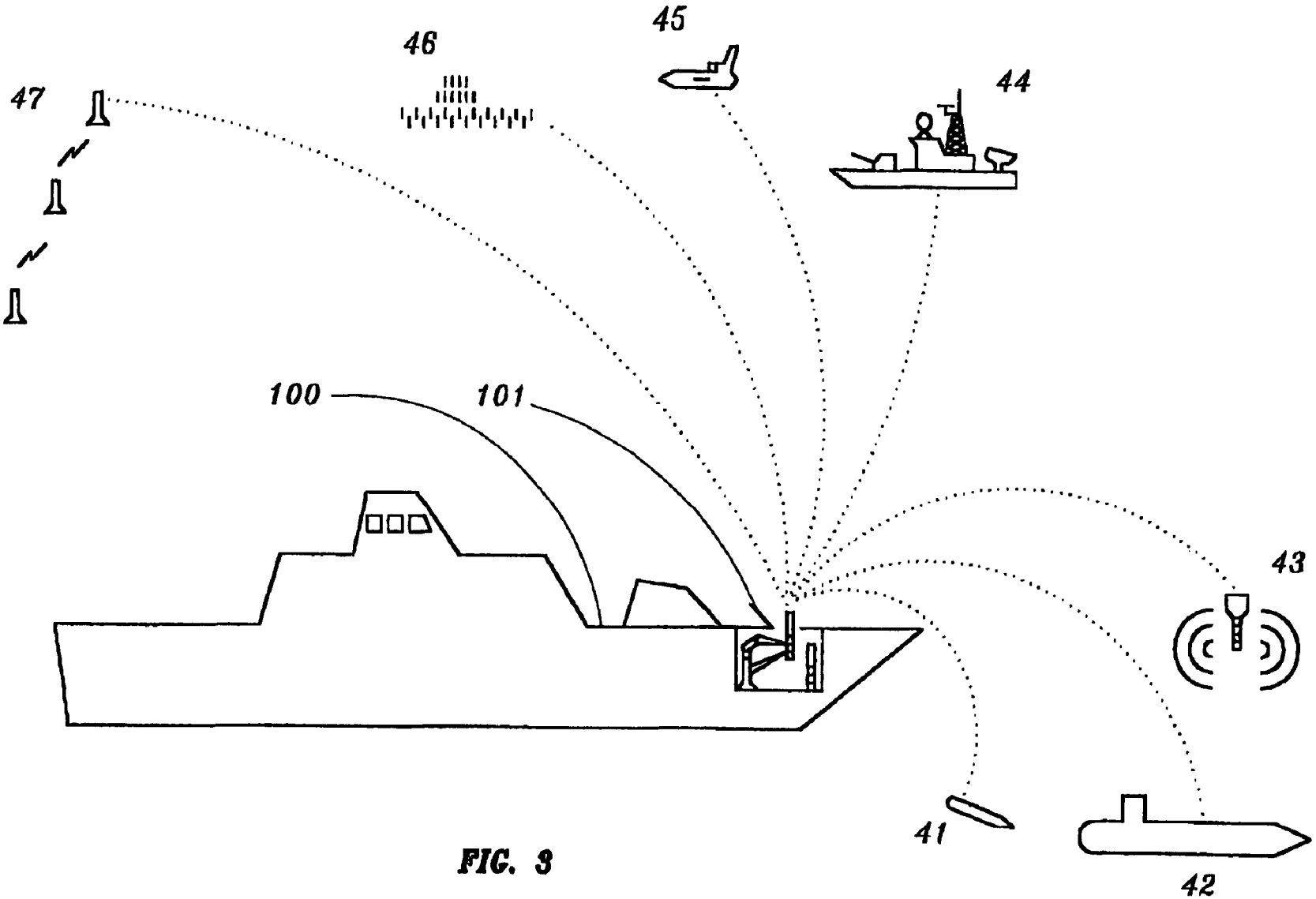
FIG. 3 shows rocket launcher systems and applications.

FIG. 3 shows a rocket launcher system placed on a ship. The launcher, the charger and the magazine are placed below deck (100) to improve the ship's stealth capability. Only when the rocket missile is to be fired, a hatch (101) is opened and part of the launcher (15) becomes visible. The magazine may contain rocket missiles of various types. FIG. 3 shows as examples rocket missiles for/with torpedo countermeasures (41), anti-submarine warfare (42), sonar buoys (43), surface target warfare (44), close support/air defence (45), deception (46) and telecommunication link buoys (47).

Figure 4A:
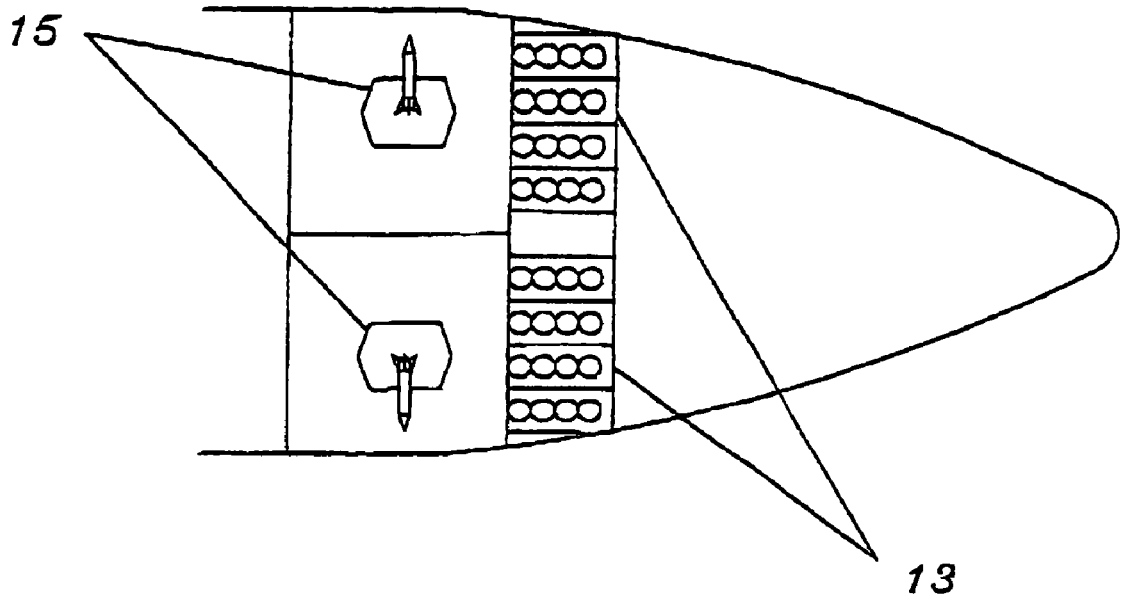
FIGS. 4*a–b* show a rocket launcher system placed below deck.
Figure 4B:
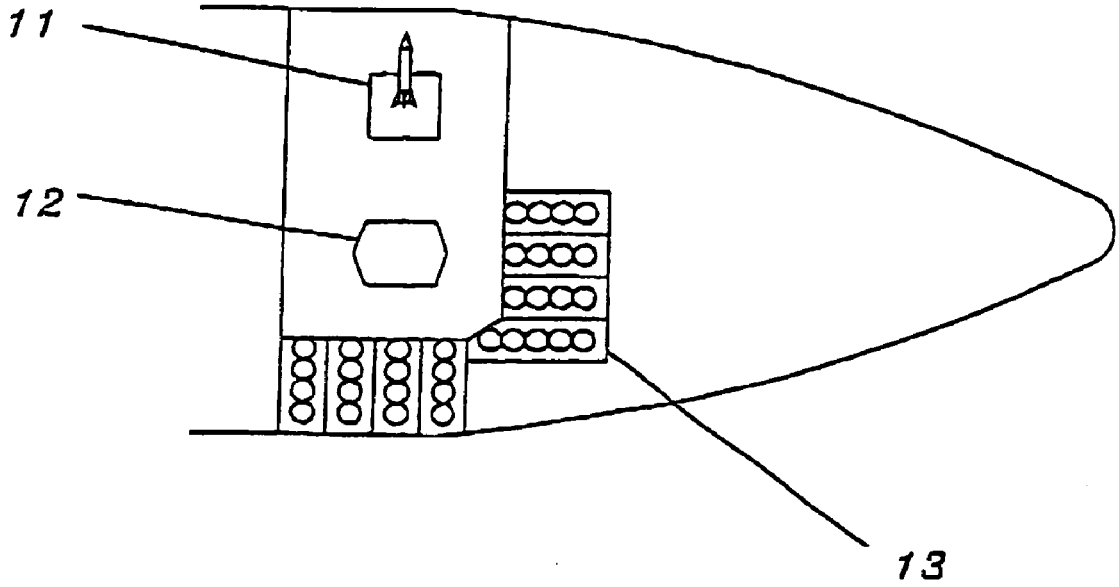
Figure 9:
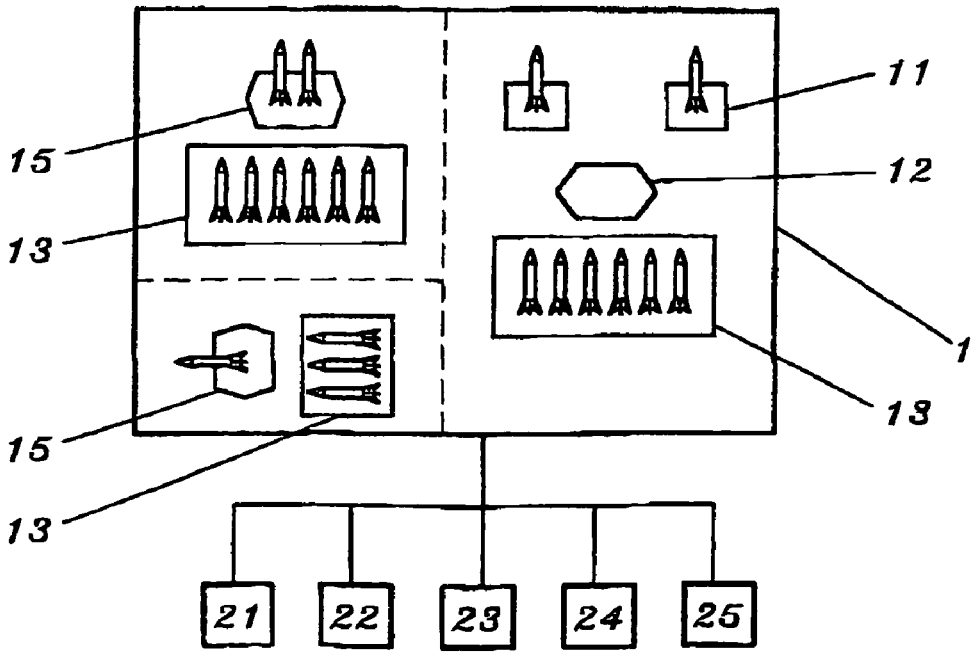
FIG. 9 shows a rocket launcher system with a plurality of chargers, launchers and magazines.

FIGS. 4*a–b* show two examples of how the rocket launcher system can be placed on a ship. In FIG. 4*a*, the rocket launcher system has two launchers with chargers (15) and a magazine (13) each. In FIG. 4*b*, a launcher (11) is placed on the port side and a magazine (13) on the starboard side. A charger (12) is placed between the launcher (11) and the magazine (13). The system may also comprise a plurality of launchers with chargers (15) and magazines (13), launchers with more than one charger or chargers (12) which charge more than one launcher (11) (see FIG. 9).

Figure 5:
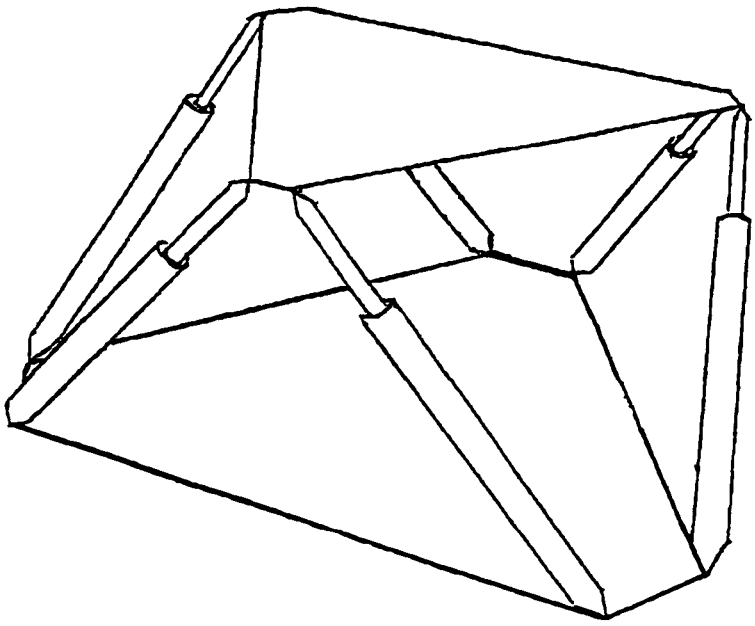
FIG. 5 shows an example of a hexapod for a launcher/charger.

FIGS. 5–7 show an example of a preferred embodiment of part of the launcher. Here the launcher has the shape of a parallel kinematic robot, for instance of the hexapod or TAU type.

FIG. 5 shows an example of the structure of a hexapod robot. Hexapod robots are known from e.g. FR 2,757,440 A1. Its legs, which are operated hydraulically or in some other manner, are used for aligning and gyrostabilising the top plate with its rocket missile attachment. The length of the legs and the geometric strut of the robot give the robot its range.

Figure 6A:
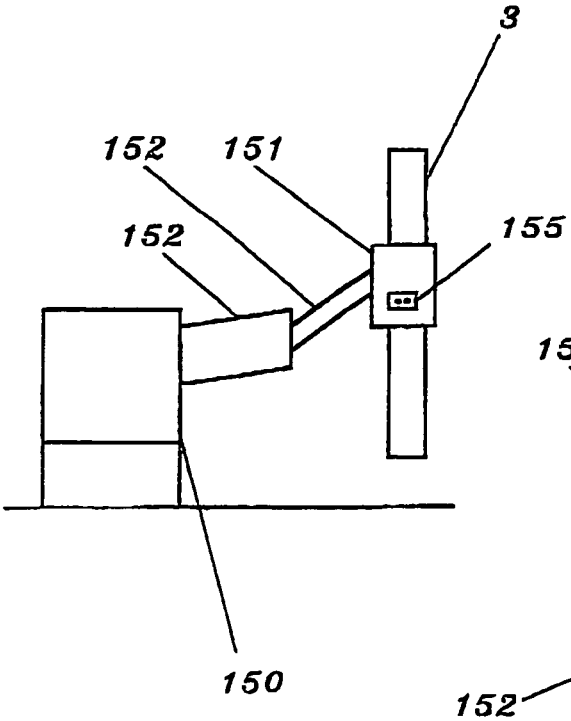
FIGS. 6*a–b* show an example of a launcher/charger.
Figure 6B:
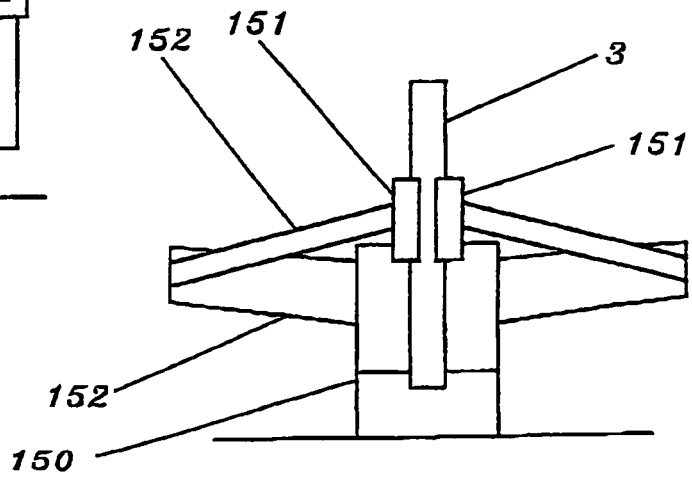

FIGS. 6*a–b* show an example of a hexapod robot which is used as charger as well as launcher. The charger/launcher comprises arms (152) with gripping means (151) and a hexapod part (150). The hexapod part (150) is used for sighting the rocket missile (3) before firing and for gyrostabilising the robot during the sighting and fixing sequence. When the robot operates as a charger, the hexapod part is used for turning about the vertical axis of the robot and to assist the aims (152) and gripping means (151) of the robot to reach the magazine. To be able to communicate with the rocket missile (30), the gripping means (151) has an infological connection (155) to the rocket missile (3). The connection (155) can transfer preparation data and ignition impulses.

FIGS. 7*a–c* show how a TAU robot of SCARA type is used as launcher and charger. FIG. 7*a* shows how the robot (15) grasps a rocket missile (3) using its gripping device (151). A hatch (101) in the deck (100) is opened and the rocket missile (3) is sighted, by means of the robot arms (152), at a target area (4) for firing through the hole in the deck (100). FIG. 7*b* shows the same situation as in FIG. 7*a* from another angle. FIG. 7*c* shows the robot (15) from above together with a magazine (13) containing rocket missiles and a discharge place for empty rocket tubes (30).

The parallel kinematic robot can be used as launcher only, requiring a small range but great accuracy in gyrostabilising and aligning, as charger, requiring a great range and rapidity, or as both charger and launcher, requiring a great range, rapidity and accuracy. To achieve this in a technically and economically advantageous manner, the robot uses two different modes. The different modes use different coordinate systems. The first mode uses a spatial coordinate system and is used in charging. No gyrostabilising is necessary and accuracy does not have to be very great, the position of the magazine and an optional separate launcher relative to the charger is always the same. This means that the robot can move quickly with a great range. The second mode uses a global coordinate system and is used in sighting and firing the rocket missile. Here accurate gyrostabilising is necessary to compensate for the movements of the ship and exact sighting. Since the movements of the robot are small, they need not be very quick, but very accurate.

The launcher is advantageously made of a non-magnetic material resistant to the hot powder gases forming in connection with firing, corrosive air mixed with salt and flushing with sea water. An example is coating a weight-optimised material, for instance high-strength steel, titanium or aluminium, for the actual robot structure with a heat insulating ceramic material.

The rocket launcher system also has a sighting restricting function which prevents the launcher from being sighted/fired in predefined directions, thereby mainly preventing firing at its own ship.

Figure 8:
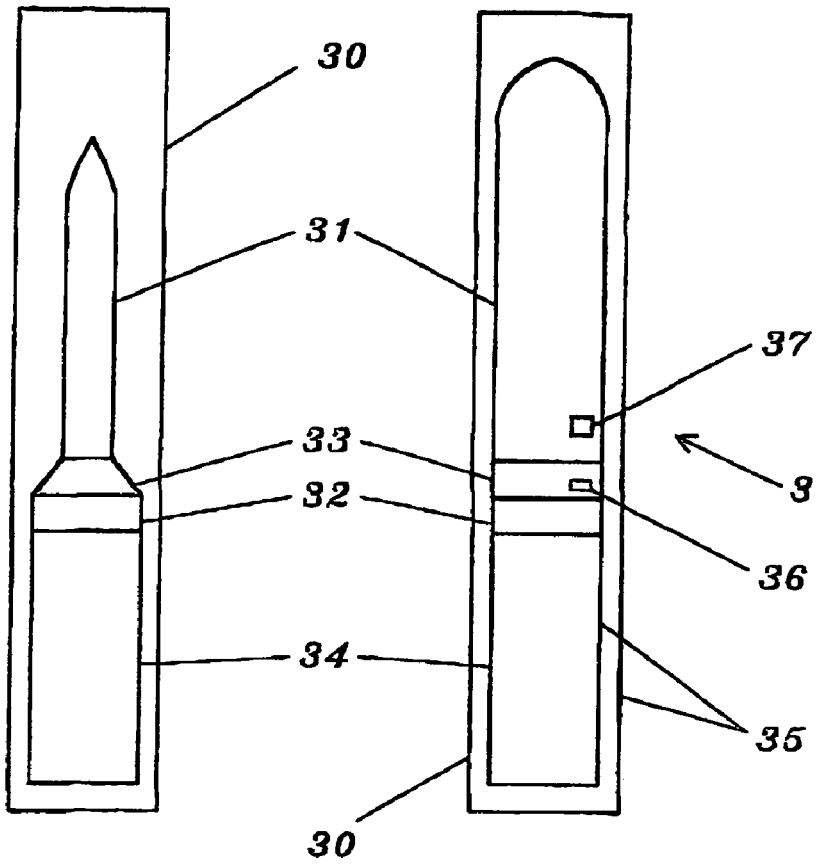
FIG. 8 shows a standard rocket missile.

FIG. 8 shows an embodiment of a rocket missile. The rocket missile (3) consists of a rocket tube (30), a rocket engine (34) common to all types of payloads (31), a divided adjusting part (32, 33) and a payload (31). The rocket tube (30) is formed as a general carrying body with a well-defined boundary surface, infologically as well as mechanically, to a magazine (13), a charger (12), and a launcher (11) as well as the rocket engine (34), the adjusting parts (32, 33) and the payload (31). The divided adjusting part (32, 33) is made up of two parts. The first adjusting part (33) belongs to the rocket engine (34) and is common to the system, the second adjusting part (32) is unique to each type of payload (31). The advantage of a divided adjusting part is that it will be considerably less expensive and less complicated than an adjusting part that fits all different kinds of payloads. Moreover, it will be easier to adjust new payloads to the system. In the first adjusting part (32), the adjusting part of the rocket engine, there is an ignition impulse and preparation data transfer interface to launcher (11), charger (12) and/or magazine (13). The preparation data and any ignition impulses concerning the payload (31) pass on to the second adjusting part (33), the adjusting part of the payload, and through the same into the payload (31). The preparation advantageously takes place by radio while the ignition impulse transfer takes place inductively using coils. This would allow the rocket missile (3) to be prepared with final data after firing, i.e. active guiding in air phase with the possibility of target correction and transfer of updated target data.

The rocket missile (3) can be provided with different types of payloads (31), such as torpedo countermeasures (41), anti-submarine ammunition (42), sonar buoys (43), surface target ammunition (44), air target ammunition (45), deception ammunition (46) or telecommunication link buoys (47). The payload (31) can have the same diameter as the rocket engine (FIG. 5*b*) or alternatively a larger or smaller diameter (FIG. 8*a*). The length of the payload (31) can also vary in the rocket tube (30).

For the system to know what types of rocket missiles (3) are available, how many of each sort are available and where they are located in the magazines (13), each rocket missile (3) has a built-in recognition code (35, 36, 37). The code (35, 36, 37) is conveniently read in a wireless manner and does not require the rocket missile (3) to be provided with its own internal power supply. Examples of suitable code systems are bar code (35), coil (36) or microwave transponder (37).

When supplying rocket missiles (3) to the magazine (13), the code (35, 36, 37) is read and the rocket missile is registered. This information about the number of rocket missiles, types and their location in the magazine is stored in the rocket launcher system so that the operator/operators (2; 21, 22, 23, 24, 25) can see what is available. The supply of rocket missiles to the magazine is conveniently carried out manually by a charger.

Preparation of rocket missiles suitably takes place in the magazine (13). In this manner, several missiles (3) can be prepared simultaneously, independently of each other. For the preparation of the rocket missiles (3), the magazine (13) has one or more infological connections to the rocket missiles. The preparation can also take place in the charger (12) and/or the launcher (11), but advantageously only updating of preparation data takes places there. The charger (12) and the launcher (11) then need only to fetch the correct rocket missile, optionally update preparation data, sight and fire the rocket missile.

Using rocket missiles comprising rocket tubes has advantages as well as disadvantages. The advantages are mainly handleability inside and outside the system. Launcher, charger and magazine need not have special connections to each type of rocket missile, but all types of rocket missiles have the same dimensions and the same information-transferring connection to the system. A disadvantage, however, is that the empty rocket tubes must be quickly and easily removed from the launcher before the next charging. One way of solving this is to have a special place in the magazine to which empty rocket tubes are supplied. A different way is charging just every second row in the magazine. The empty rows are then used to dump the empty tubes. In this way, the charger moves to the correct type of ammunition for the next shot and chooses the adjacent row for empty rocket tubes to be dumped. This means that the dumping place and the charging place are very close to each other, which saves a great deal of time.

Alternatively, rocket missiles without rocket tubes can be used. This necessitates a more advanced charger and launcher. The charger/launcher is then equipped with, for instance, a rocket the divided into the parts, where the two front parts are movable and serve as the active parts of the gripping means and thus integrate the functions of the rocket tube and gripping means.

One of the most important properties of the rocket launcher system is that it can handle a large number of different types of rocket missiles, which can be handled by several operators simultaneously.

Below follows an example. A number of operators (operations) (2; 21, 22, 23, 24, 25) can use the rocket launcher system (1) at the same time. The operations which above all are of interest are: anti-submarine warfare (42, 43) and underwater defence (41), air defence, electric and electronic warfare and surface warfare (44). Before use, a captain or the like distributes the rocket launcher system to the operators involved who can thus use the system. All operators carry out planning and preparation of their own operations independently of each other. An operation can take place simultaneously and independently of whether the system has several launchers or a launcher accommodating two or more rocket missiles. If a bottle neck arises somewhere in the system, for instance if the charger or launcher is not quick enough, queuing is arranged. Redistribution and listing different functions in order of priority is made directly by the captain, or else the system makes up a dynamic list. The dynamic list is continuously updated by means of the ship's sensors and other available sensors and the operators, so that the operations can be listed in order of priority in an optimal fashion. The advantage of a dynamic list is mainly when the ship encounters a situation that requires a plurality of operations at the same time and a manual listing of the operations in the order of priority is too slow.

Examples of data for a rocket launcher system according to the invention. The total system weight is 2500 kg, the launcher accommodates one rocket tube and has a recharging time for a rocket tube of 20 s. The recharging can be repeated continuously until all rocket missiles in the magazine are finished. The magazine holds 40–80 rocket missiles of four different types. The rocket missiles weigh about 50 kg each and comprise a two meter long rocket tube having a diameter of 0.13 m. The launcher has some kind of insert for accommodating/holding rocket tubes having a varying diameter of 0.10–0.30 m.

The rocket launcher system is here described on a ship. However, the system can also be used on shore when rocket launcher systems are to be concealed or placed in closed spaces, for instance in installations below ground or on vehicles.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

The invention claimed is:

1. A rocket launcher system for a ship comprising a parallel kinematic robot configured to operate as a charger and as a launcher, said parallel kinematic robot being rotatable about a vertical axis thereof and having a gripping device to take a rocket missile from a magazine preparatory to launch, and a sighting component to sight said rocket missile at a target area.

2. The rocket launcher system according to claim 1, wherein the rocket missile is charged with preparation data.

3. The rocket launcher system according to claim 2 wherein the rocket missile is charged with the preparation data in the magazine before said missile is taken by the parallel kinematic robot.

4. The rocket launcher system according to claim 1, wherein the magazine contains different types of rocket missiles including anti-submarine weapons, countermeasures, surface target weapons and sensors.

5. The rocket launcher system according to claim 4, wherein two or more operators can prepare different rocket missiles simultaneously.

6. The rocket launcher system according to claim 1, wherein the rocket launcher system is arranged below deck of said ship to improve a stealth capability of said ship.

7. The rocket launcher system according to claim 1, wherein the parallel kinematic robot is gyrostabilised.

8. The rocket launcher system according to claim 1, wherein said gripping device is configured to handle rocket missiles placed in a rocket tube, said parallel kinematic robot further including a connection for transferring information, ignition impulse and preparation data, to the rocket missile.

9. The rocket launcher system according to claim 1, wherein said parallel kinematic robot has an integrated gripping/rocket tube device for handling rocket missiles without rocket tubes and a connection for transferring information, ignition impulse and preparation data, to the rocket missile.

10. The rocket launcher system according to claim 1, wherein structural components of the parallel kinematic robot are made of a non-magnetic, light weight heat- and corrosion-resistant material.

11. The rocket launcher system according to claim 1, wherein the rocket missile includes a system common rocket engine, a divided adjusting unit and a payload.

12. The rocket launcher system according to claim 11, wherein the divided adjusting unit includes two adjusting parts, a system common first adjusting part with ignition impulse and preparation data transfer interface to the magazine and/or the parallel kinematic robot, and a second adjusting part which is unique to each payload and receives preparation data for the payload from the first adjusting part and passes said preparation data on to the payload.

13. The rocket launcher system according to claim 12, wherein data transfer from the magazine and/or the parallel kinematic robot to the first adjusting part occurs in a wireless manner.

14. The rocket launcher system according to claim 1, wherein data transfer from the rocket launcher system to the rocket missile after missile launch takes place by radio or wire.

15. The rocket launcher system according to claim 1, wherein each rocket missile has a recognition code embodied as a bar code.

16. The rocket launcher system according to claim 1, wherein the rocket launcher system includes a plurality of parallel kinematic robots and magazines.

17. A method for controlling a rocket launcher system for ships, comprising the steps of:

transferring an operating signal containing preparation data to the rocket launcher system, said rocket launcher system including at least one parallel kinematic robot configured to operate as a charger and as a launcher;

transferring preparation data to a rocket missile;

taking, by said parallel kinematic robot controlled by the operating signal, the rocket missile from a magazine; and sighting, by the parallel kinematic robot as controlled by the operating signal, the rocket missile at a target area.

18. The method according to claim 17, wherein preparation data is transferred to the rocket missile while said rocket missile is in the magazine.

19. The method according to claim 18, wherein the parallel kinematic robot, controlled by the operating signal which includes data about type of rocket missile requested to be charged, is caused to take the requested rocket missile type from a magazine containing more than one type of rocket missile.

20. The method according to claim 17, wherein the operating signal is transferred by one or more operators, and several operating signals can be transferred to the system simultaneously.

21. The method according to claim 20, wherein the operating signals are stored when the parallel kinematic robot is occupied.

22. The method according to claim 21, wherein the preparation data of the operating signals is stored in the rocket missiles involved, when said missiles are in the magazine.

23. The method according to claim 21, further comprising the steps of:

listing the stored operating signals in order of priority and making a dynamic list; and redistributing and listing, by one of the operators, the stored operating signals in order of priority.

24. The method according to claim 17, further comprising the steps of:

firing the rocket missile from the parallel kinematic robot; and updating the preparation data of the rocket missile after firing.

25. The method according to claim 17, wherein the parallel kinematic robot operates according to a spatial coordinate system when taking said missile from said magazine and, when sighting and firing, operates according to a global coordinate system.

* * * * *